US006533236B1

(12) United States Patent
MacLellan et al.

(10) Patent No.: US 6,533,236 B1
(45) Date of Patent: Mar. 18, 2003

(54) APPARATUS FOR HOLDING INTERCONNECTABLE CARDS

(75) Inventors: Josene A. MacLellan, Commerce Township, MI (US); David J. Angel, Franklin, MI (US); Suzette A. Timoszyk, Westland, MI (US)

(73) Assignee: The Auto Club Group, Dearborn, MI (US)

( * ) Notice: Subject to any disclaimer, the term of this patent is extended or adjusted under 35 U.S.C. 154(b) by 0 days.

(21) Appl. No.: 10/003,812

(22) Filed: Oct. 25, 2001

(51) Int. Cl.[7] ..... B42F 13/00; B42F 19/04

(52) U.S. Cl. ..... 248/442.2; 248/447.1; 248/918; 40/404

(58) Field of Search ..... 248/442.2, 447.1, 248/459, 205.3, 683, 447.2, 918; D19/89, 90, 91; 40/371, 391, 404, 594, 651, 725; 206/425

(56) References Cited

U.S. PATENT DOCUMENTS

| | | | | | |
|---|---|---|---|---|---|
| D190,260 | S | * | 5/1961 | Neilsen | D19/76 |
| 4,475,705 | A | * | 10/1984 | Henneberg et al. | 248/231.81 |
| 4,693,443 | A | * | 9/1987 | Drain | 211/89.01 |
| 4,747,572 | A | | 5/1988 | Weber | 248/442.2 |
| 4,960,257 | A | * | 10/1990 | Waters | 248/442.2 |
| 5,082,235 | A | | 1/1992 | Crowther et al. | 248/231.41 |
| 5,125,612 | A | | 6/1992 | McNeal | 248/442.2 |
| D331,424 | S | * | 12/1992 | Evenson | D19/75 |
| 5,383,642 | A | | 1/1995 | Strassberg | 248/442.2 |
| 5,441,229 | A | | 8/1995 | Spagnoli | 248/452 |
| 5,620,162 | A | | 4/1997 | Beckwith et al. | 248/442.2 |
| D396,491 | S | * | 7/1998 | Cheris et al. | D19/75 |
| 5,881,986 | A | * | 3/1999 | Hegarty | 248/442.2 |
| 5,890,603 | A | | 4/1999 | Arguin et al. | 211/45 |
| 6,007,891 | A | * | 12/1999 | Davis et al. | 15/141.2 |
| 6,024,337 | A | * | 2/2000 | Correa | 248/442.2 |
| 6,299,325 | B1 | * | 10/2001 | Cathel | 232/34 |

* cited by examiner

*Primary Examiner*—Ramon O. Ramirez
*Assistant Examiner*—Jon Szumny
(74) *Attorney, Agent, or Firm*—Brooks & Kushman P.C.

(57) ABSTRACT

An apparatus for holding interconnectable cards on either side of a computer monitor. The holder includes a one-piece construction having a side fold, a pair of ells, a body, and a fastener portion. An adhesive is affixed to the side fold and interconnectable instructional cards are attached to the fastener portion, whereby the adhesive remains affixed to the side fold and allows the holder to be repeatably affixable and removable from either side of the monitor, and the fastener portion allows the user to flip through and view the instructional cards.

11 Claims, 2 Drawing Sheets

APPARATUS FOR HOLDING INTERCONNECTABLE CARDS

BACKGROUND OF THE INVENTION

1. Field of the Invention

The present invention relates to a device for holding instructional cards in close proximity to a computer monitor, and particularly to a holder that is repeatably fixable to and removable from the monitor so that a user can flip through and view the instructional card.

2. Background Art

A computer monitor typically comprises a computer screen enclosed in some fashion by a plastic housing structure. Informational cards and papers are often secured in some manner to the housing so that a computer user can flip through and view the cards without having to substantially direct their attention away from the computer screen.

Generally, most of the holders attached to the housing are either affixed thereto by a mechanical pressure fastening means or a non-removable adhesive. Mechanical pressure fastening means usual includes any device, which in order for it to be secured to the monitor housing, requires the user to either screw, clip, tighten or otherwise manipulate the holder to exert some type of holding pressure upon the housing. Non-removable fastening means usually involve adhesive devices, such a glue, tape, and velcro, in which a substantial portion of the adhesive substance remains affixed to the monitor housing. In either case, it is difficult for the holder to be easily and repeatedly affixable to and removable from either side of the monitor.

For example, U.S. Pat. No. 5,890,603 relates to an article display device which includes a substantially flexible and lengthwise deformable band that extends around a parameter of an appliance. U.S. Pat. No. 5,620,162 relates to an adjustable paper holder having a resiliently compressible friction member compressed between relatively movable portions of the paper holder to attach it to either side of a monitor. U.S. Pat. No. 5,441,229 relates to an assemblage for holding flight charts with a spring clip at an upper end. U.S. Pat. No. 5,383,642 relates to a device for retaining information sheets in close proximity to a display screen using a clamp that secures the device to the display screen. U.S. Pat. No. 5,125,612 relates to an adjustable sheet support system consisting of a pair of L-shaped components which are adjustable and slidably engaged along the top of a video screen. U.S. Pat. No. 5,082,235 relates to an apparatus for holding documents using a clamp that grips a housing of a display. U.S. Pat. No. 4,747,572 relates to an apparatus which removable attaches to a computer terminal to display and hold materials using Velcro.

An invention is provided that allows for the holder to be repeatedly affixable to and removable from either side of the monitor without requiring a mechanical pressure fastening means or a non-removable adhesive.

SUMMARY OF THE INVENTION

This invention provides an apparatus for holding interconnectable cards in close proximity to a monitor.

In an embodiment of the present invention, an apparatus is provided for holding interconnectable cards on either side of a computer monitor so that a computer user can flip through and view the cards.

In an embodiment of the present invention, an apparatus comprising a holder and an adhesive attached thereto is disclosed for holding interconnectable instructional cards on either side of a computer monitor so that a user can flip through and view the cards. The holder is a one piece construction comprising a side fold having a surface expanse, a pair of ells at the apogean ends of the side fold, a body area being flanked by the side fold and the pair of ells and a fastener portion in the body area sufficiently loosely interconnectable with the interconnectable cards so that the computer user can put through and view the cards. An adhesive for securing the holder to the computer monitor is affixed to a sufficient expanse of the side fold surface. In this manner, the adhesive remains affixed to the side fold and the holder is repeatedly affixable and removable from any side of the monitor.

In an embodiment of the present invention, a fastener portion comprises at least two fastener members.

In an embodiment of the present invention, a fastener member is characterized by hollows within a body area of a holder.

In an embodiment of the present invention, instructional cards are interconnectable with a fastener portion by forcing a sufficiently narrow channel of the card over the fastener portion until a sufficiently larger channel is reached. The sufficiently narrow channel at least partially prevents undesirable removal of the cards from the larger channel is reached, so that the computer user can flip through and view the cards.

In an embodiment of the present invention, at least one ell provides a ledge for supporting an edge of a card.

In an embodiment of the present invention, an adhesive is used for attaching a holder having ends to a computer monitor. The adhesive is a double-sided pressure sensitive tape that is sufficiently bonding to securably bear the weight of the holder having cards.

In an embodiment of the present invention, a body area of a holder housing is dimensioned to only receive three by five cards.

In an embodiment of the present invention, a holder of the instructional cards is disclosed having a one-piece plastic material construction.

In an embodiment of the present invention, tabs are included on the card interconnectable for flipping the cards.

In an embodiment of the present invention, a holder is disclosed having a side fold and a pair of ells extending from the apogean ends of the side fold. The side fold reversably extends opposite to a direction in which a surface extension of the ells extends.

In an embodiment of the present invention, a method for a computer is user to flip through and examine instructional cards positionable around a computer monitor is disclosed. The method includes providing a set of interconnectable instructional cards for placement into a holder. The method further comprises constructing the holder with a side fold that engages the monitor, a body area with a fastener portion sufficiently loosely interconnectable with the interconnectable cards that the user can leaf through and select a card for examining, and a pair of ells along an upper portion and a lower portion of the body for at least partially supporting at least one edge of a card. The method still further comprises securably affixing the holder on the computer monitor using an adhesive affixed to a sufficient expanse of the side fold, wherein the adhesive is sufficiently affixable to the side fold that the holder is repeatably affixable to and removable from any side of the monitor while the adhesive remains affixed to the side fold.

DETAILED DESCRIPTION OF THE PREFERRED EMBODIMENT(S)

Figure 1:
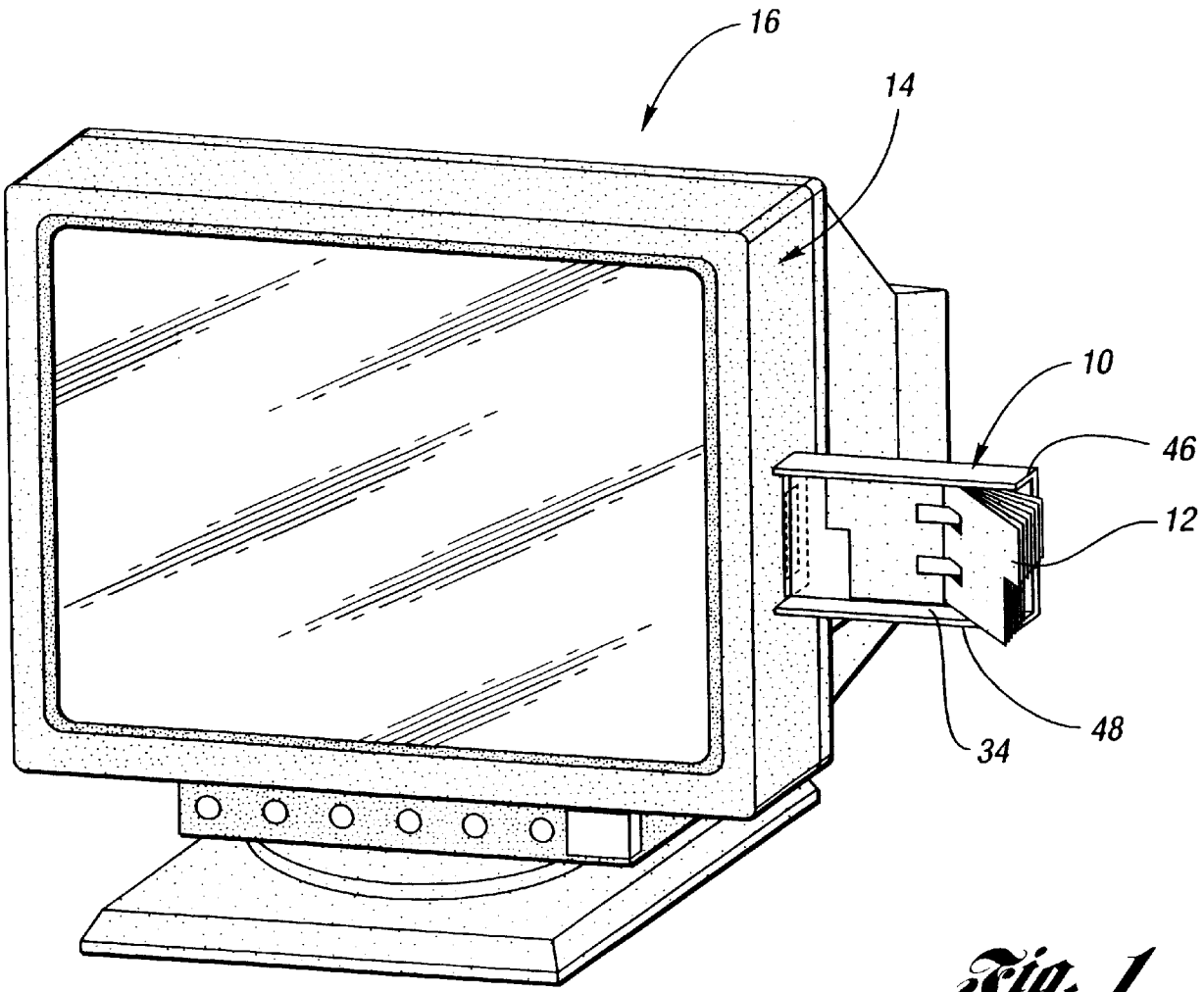
FIG. 1 is a perspective view of an apparatus for holding interconnectable cards when affixed to any side of a monitor according to an embodiment of the present invention.

FIG. 1 illustrates holder 10 for holding interconnectable cards 12 on any side 14 of computer monitor 16 so that a computer user can flip through and view cards 12. Holder 10 is particularly useful because it is placeable on any side 14 of monitor 16 having a sufficient surface area for receiving holder 10. Holder 10 is a one-piece construction comprising side fold 20, a pair of ells 22, body area 24, and fastener portion 26.

Figure 2:
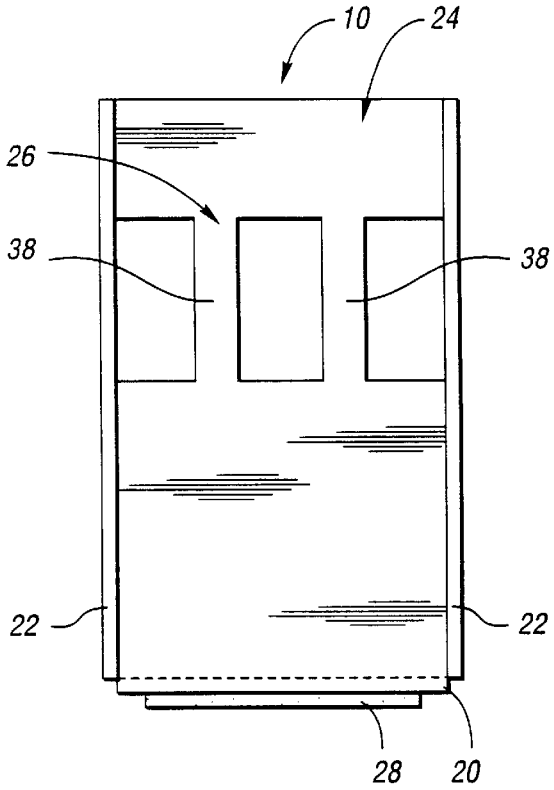
FIG. 2 is a front view of a holder for holding interconnectable cards according to an embodiment of the present invention.

As shown in FIG. 2, adhesive 28 is affixable to holder 10. Holder 10 thereby is affixable to any portion of monitor 16 that has a sufficient area for securably receiving adhesive 28. Adhesive 28 is typically a double-sided pressure sensitive tape that is sufficiently bonding to securably bear the weight of holder 10 having cards 12 when affixed to monitor 16. As such, holder 10 is repeatably affixable to and removable from any side of monitor 16 while adhesive 28 remains affixed to side fold 20.

Figure 3:
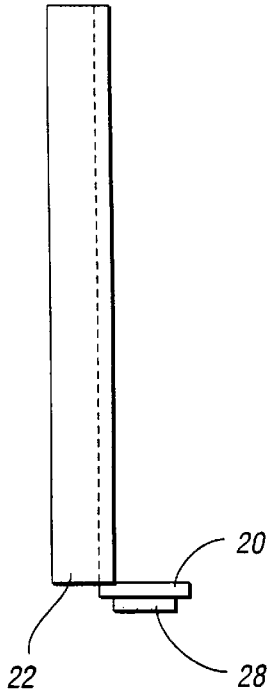
FIG. 3 is a side view of a holder for holding interconnectable cards according to an embodiment of the present invention.
Figure 4:
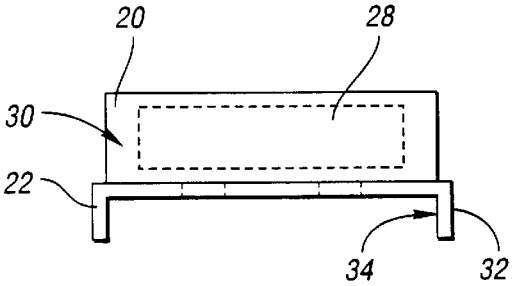
FIG. 4 is an end view of a holder for holding interconnectable cards according to an embodiment of the present invention.

FIG. 3 is a side view of holder 10 that illustrates ells 22 reversibly extending opposite to the direction in which side fold 20 extends. The end view of FIG. 4 shows ells 22 connect to the apogean ends of side fold 20. The side fold 20 includes surface expanse 30. Surface expanse 30 is sufficiently large to receive adhesive 28. Adhesive 28 is suitable for reliably securing holder 10 to monitor 16. Ells 22 include a surface extension 32 that provides a ledge 34.

Figure 5:
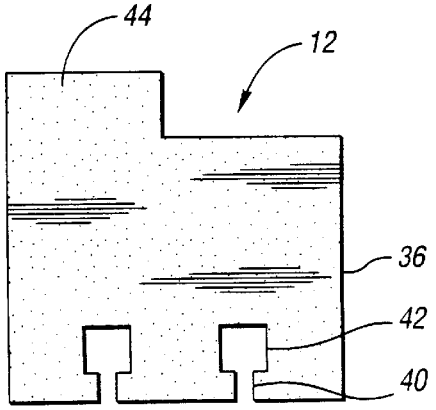
FIG. 5 is a front view of an interconnectable card holdable by a holder according to an embodiment of the present invention.

The type of card 12 illustrated in FIG. 5 can be connected to the holder 10. Card 12 is connected within body 24 of holder 10. Body area 24 is flanked by side fold 20 and ells 22. Body area 24 includes a fastener portion 26 sufficiently loosely interconnectable with interconnectable cards 12 so that computer user 18 can flip through and view cards 12. Surface extension 32 provides a ledge 34 for supporting card edge 36. Fastener portion 26 typically comprises at least two fastener members 38. Cards 12 are fastened to fastener portion 26 by forcing narrow channel 40 over fastener members 38 until sufficiently larger channel 42 is reached. Narrow channel 40 at least partially prevents undesirable removal of cards 12 from larger channel 42. Card 12 may also include tab 44 for aiding the computer user in flipping through and viewing cards 12. Body area 24 includes upper portion 46 and lower portion 48, wherein lower portion 48 depends on the orientation of holder 10, such that lower portion 48 supports card edges 36.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An apparatus for holding interconnectable cards on any side of a computer monitor so that a computer user can flip through and view the cards; the apparatus comprising:

a holder having a one-piece construction, wherein the holder comprises, a side fold having a surface expanse;

a pair of ells at the apogean ends of the side fold;

a body area being flanked by the side fold and the ells; and a fastener portion within the body area loosely interconnectable with the interconnectable cards so that the computer user can flip through and view the cards; and an adhesive affixed to an expanse of the side fold surface for securing the holder to the computer monitor, wherein the adhesive is affixed to the side fold such that the holder is repeatably affixable to and removable from either side of the monitor while the adhesive remains affixed to the side fold.

2. The apparatus of claim 1, wherein the fastener portion comprises at least two fastener members.

3. The apparatus of claim 2, wherein the fastener members are characterized by hollows within the body area.

4. The apparatus of claim 1, wherein the cards are connectable with the fastener portion by forcing a narrow channel of the card over the fastener portion until a larger channel is reached, wherein the narrow channel at least partially prevents undesirable removal of the cards from the larger channel so that the computer user can flip through and view each card.

5. The apparatus of claim 1, wherein at least one of the ells provides a ledge for supporting card edges.

6. The apparatus of claim 1, wherein the adhesive is a double-sided pressure sensitive tape that is bonding to securably bear a weight of the holder having cards.

7. The apparatus of claim 1, wherein the body area is dimensioned to only receive 3×5 cards.

8. The apparatus of claim 1, wherein the one-piece holder comprises a plastic material.

9. The apparatus of claim 1, wherein the cards include tabs for flipping.

10. The apparatus of claim 1, wherein the side fold reversely extends opposite to the direction in which a surface extension the ells extend.

11. A method for a computer user to leaf through and examine instructional cards adapted to be positionable around a computer monitor, the method comprising;

providing a set of interconnectable instructional cards;

constructing a holder having:

a side fold that engages the monitor;

a body area with a fastener portion within the body loosely interconnectable with the interconnectable cards so that the user can leaf through and select a card for examining; and a pair of ells along an upper portion and a lower portion of the body, wherein at least one of the ells at least partially supports a card edge; and securably affixing the holder around the computer monitor using an adhesive affixed to an expanse of the side fold, wherein the adhesive is affixed to the side fold such that the holder is repeatably affixable to and removable from any side of the monitor while the adhesive remains affixed to the side fold.

* * * * *

UNITED STATES PATENT AND TRADEMARK OFFICE

CERTIFICATE OF CORRECTION

PATENT NO. : 6,533,236 B1
DATED : March 18, 2003
INVENTOR(S) : Josene A. MacLellan et al.

It is certified that error appears in the above-identified patent and that said Letters Patent is hereby corrected as shown below:

Column 4,
Lines 4-22, delete Claim 1 and insert therefor:

--1. An apparatus for holding interconnectable cards on any side of a computer monitor so that a computer user can flip through and view the cards; the apparatus comprising:

interconnectable cards having a narrow channel and a larger channel;

a holder having a one-piece construction, wherein the holder comprises, a side fold having a surface expanse;

a pair of ells at the apogean ends of the side fold;

a body area being flanked by the side fold and the ells; and a fastener portion within the body area loosely interconnectable with the interconnectable cards, whereby the cards are connectable with the fastener portion by forcing the narrow channel of the card over the fastener portion until the larger channel is reached so that the computer user can flip through and view the cards; and an adhesive affixed to an expanse of the side fold surface for securing the holder to the computer monitor, wherein the adhesive is affixed to the side fold such that the holder is repeatably affixable to and removable from either side of the monitor while the adhesive remains affixed to the side fold.--

Lines 27-33, delete Claim 4 and insert therefor:
-- 4. The apparatus of claim 1, whereby the narrow channel at least partially prevents undesirable removal of the cards from the larger channel so that the computer user can flip through and view each card. --

Lines 42-43, delete Claim 9 and insert therefor:
-- 9. The apparatus of claim 1, whereby the cards include tabs for flipping the cards. --

Lines 44-46, delete Claim 10 and insert therefor:
-- 10. The apparatus of claim 1, wherein the side fold reversely extends opposite to the direction in which a surface extension of the ells extend. --

UNITED STATES PATENT AND TRADEMARK OFFICE

CERTIFICATE OF CORRECTION

PATENT NO. : 6,533,236 B1 
DATED : March 18, 2003
INVENTOR(S) : Josene A. MacLellan et al.

It is certified that error appears in the above-identified patent and that said Letters Patent is hereby corrected as shown below:

Column 4 cont'd,
Lines 47-65, delete Claim 11 and insert therefor:

--11. A method for a computer user to leaf through and examine instructional cards adapted to be positionable around a computer monitor, the method comprising;

providing a set of interconnectable instructional cards, the cards having a narrow channel and a larger channel;

constructing a holder having:

a side fold that engages the monitor;

a body area with a fastener portion within the body area loosely interconnectable with the interconnectable cards, whereby the cards are connectable with the fastener portion by forcing the narrow channel of the card over the fastener portion until the larger channel is reached so that the user can leaf through and select a card for examining; and a pair of ells along an upper portion and a lower portion of the body area, wherein at least one of the ells at least partially supports a card edge; and securably affixing the holder around the computer monitor using an adhesive affixed to an expanse of the side fold, wherein the adhesive is affixed to the side fold such that the holder is repeatably affixable to and removable from any side of the monitor while the adhesive remains affixed to the side fold.

Signed and Sealed this

Twelfth Day of August, 2003

JAMES E. ROGAN
*Director of the United States Patent and Trademark Office*